US006772541B1

(12) United States Patent
Ritter et al.

(10) Patent No.: US 6,772,541 B1
(45) Date of Patent: Aug. 10, 2004

(54) FOOTWEAR SECUREMENT SYSTEM

(75) Inventors: Brett D. Ritter, Santa Barbara, CA (US); Damon R. Butler, Portland, OR (US); Barry Joseph McGeough, Santa Barbara, CA (US)

(73) Assignee: Deckers Outdoor Corporation, Flagstaff, AZ (US)

( * ) Notice: Subject to any disclaimer, the term of this patent is extended or adjusted under 35 U.S.C. 154(b) by 76 days.

(21) Appl. No.: 10/130,457

(22) PCT Filed: Nov. 17, 2000

(86) PCT No.: PCT/US00/31647

§ 371 (c)(1),
(2), (4) Date: Aug. 20, 2002

(87) PCT Pub. No.: WO01/35782

PCT Pub. Date: May 25, 2001

Related U.S. Application Data

(60) Provisional application No. 60/165,990, filed on Nov. 17, 1999.

(30) Foreign Application Priority Data

Nov. 17, 1999 (US) ..... 60/165,990

(51) Int. Cl.[7] ..... A43B 7/14; A43B 7/22
(52) U.S. Cl. ..... 36/88; 36/50.1; 36/91
(58) Field of Search ..... 36/91, 50.1, 88, 36/89, 93, 114

(56) References Cited

U.S. PATENT DOCUMENTS

| | | | |
|---|---|---|---|
| 1,283,335 | A | 10/1918 | Shillcock |
| 3,327,410 | A | 6/1967 | Park, Sr., et al |
| 4,811,498 | A | 3/1989 | Barret |
| 5,379,529 | A | 1/1995 | Smith et al. |
| 5,430,959 | A | 7/1995 | Mitsui |
| 5,819,439 | A | 10/1998 | Sanchez |
| 5,960,565 | A | 10/1999 | Lochbaum |

FOREIGN PATENT DOCUMENTS

| | | |
|---|---|---|
| WO | WO 01/35782 A1 | 5/2001 |

*Primary Examiner*—M. D. Patterson
(74) *Attorney, Agent, or Firm*—Greer, Burns & Crain, Ltd.

(57) ABSTRACT

A footwear securement system for closed footwear implements a strap (100) having an X-configuration across the instep of the wearer's foot. The X-configuration instep strap (100) acts to secure the entire circumference of a wearer's foot to the footwear sole. Further, the X-configuration instep strap (100) allows for contraction and expansion of the ankle when the foot's main tendon that travels down the front of the leg and across the instep of the foot is cyclically tightened and loosened during walking or running. The X-strap (100) may optionally travel through a channel (130) located in the sole to allow for further strap adjustment during activity.

11 Claims, 7 Drawing Sheets

FIG. 5
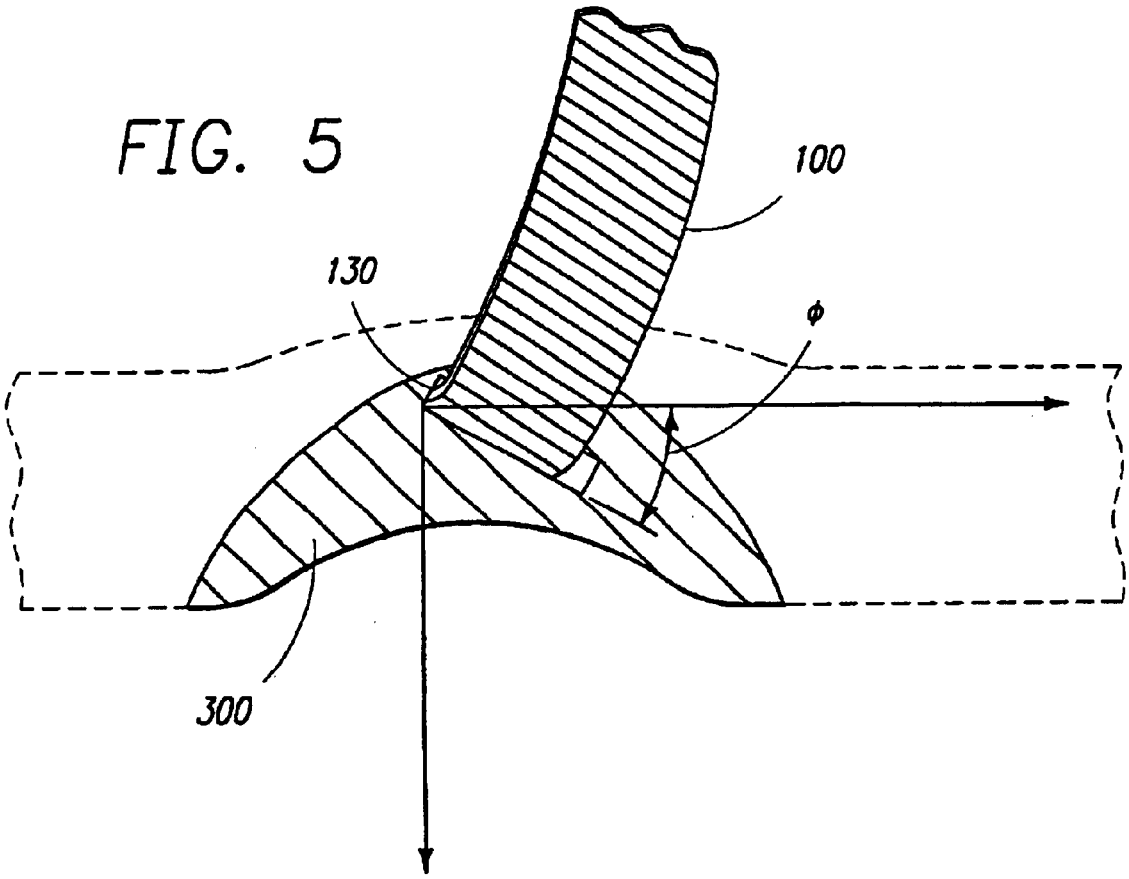
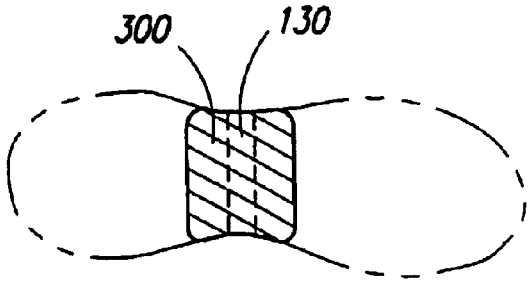
FIG. 6

FOOTWEAR SECUREMENT SYSTEM

This application claims priority to Patent Cooperation Treaty Patent Application Serial Number PCT/US00/31647, filed Nov. 17, 2000, entitled "FOOTWEAR SECUREMENT SYSTEM", which claims priority to U.S. Provisional Application Serial No. 60/165,990, filed Nov. 17, 1999, entitled "FOOTWEAR SECUREMENT SYSTEM".

BACKGROUND OF THE INVENTION

1. Field of the Invention

The present invention relates to footwear. In particular the present invention is related to strapping systems for securely affixing footwear to a user's foot.

2. Background of the Invention

There is a wide variety of prior art showing strapping configurations for footwear. Generally, the purpose of such strapping has mainly been to secure the footwear to a user's foot.

Examples of prior art showing footwear strapping arrangements include U.S. Pat. Nos. 4,200,997 and 4,446,633 to Scheinhaus, U.S. Pat. No. 4,817,302 to Saltsman, U.S. Pat. No. 4,300,294 Riecken, U.S. Pat. No. 2,788,591 to Gibson, U.S. Pat. No. 2,126,094 to Daniels, and U.S. Pat. No. 2,862,311 to Ellis. Each of these patents disclose a strapping configuration which may be used in closed and open footwear which engages the ankle, heel, instep, toes, arch, or some combination thereof to secure the footwear to the user's foot. None of these prior art disclosures, however, nor any other existing strapping configurations have been entirely satisfactory in securing footwear to the foot while providing support and maintaining a comfortable, durable, and convenient configuration.

One particular problem relates to ankle straps. As the angle between the foot and the ankle changes during normal walking or running, the foot's main tendon that travels down the front of the leg and across the instep of the foot is cyclically tightened and loosened. This causes the overall circumference of the ankle and instep to increase and decrease. It is helpful for strapping systems which wrap the ankle to allow for this expansion and contraction. Most closed footwear either does not include ankle straps or does not allow for contraction and expansion of the ankle.

Another problem results from the use of strapping configurations that have only limited contact with foot sections. For instance, some prior strapping configurations contact the foot only along a transverse axis. As forces associated with foot movement may occur along the longitudinal axis of the foot, as well as in all other directions, such transverse oriented strapping is limited in its ability to secure the foot to the sole. Balance, comfort and convenience are also limited.

Indeed, prior footwear straps are typically oriented in a direction that does not correspond to the force vectors that occur during walking, running, or other activity. Strapping usually is oriented at an angle of approximately 90° from the sole. This angle contributes to maximizing strapping strength, but generally only when the strap lies flat and parallel to the sole on the foot surface. As the top of the foot slopes forward, however, a strap oriented at a 90° angle from the sole must twist to lie flat on the sloping foot surface. This can cause discomfort in the user and diminish the strength of the strap.

During normal walking or running, the foot generally moves in an upward and forward motion, and correspondingly pulls the sole in this direction. A strap oriented at a 90° angle to the sole, however, is positioned to be at its peak strength and comfort to the user for forces directed straight upwards from the sole. These straps are therefore disadvantageous for use with a natural foot movement.

Another problem existing with many prior art closed footwear strapping configurations is the point of connection of the strapping to the sole. Strapping that is connected at isolated points generally only secures the foot to these isolated points. Often, the point of stress is at the surface of the sole and tends to be near the sole front or rear edges. Because the sole is inherently flexible, securing strapping to these isolated, static points inevitably leads to bending and unequal movement of the sole with reference to the foot, particularly during vigorous foot movement.

Other prior strapping configurations do not allow for natural movement of the foot to occur during sports or the like. While these configurations may secure the sole to the foot when stationary, they are incapable of adjusting as the foot may change shape slightly during movement. In addition, they are not well suited to accommodating forces occurring in a variety of directions during vigorous activity.

Still other prior art footwear strapping configurations feature a continuous strap that contacts the wearer's foot in multiple locations, such as around the ankle, across the instep, and over the front of the foot. Such straps cannot be snugly fit to a single portion of the wearer's foot, as they must allow for movements of other portions of the foot. A continuous strap that covers both the instep and the forefoot, for instance, may develop looseness over the instep due to movement of the forefoot.

Numerous unresolved needs therefore exist relating to footwear. A need exists for a footwear strapping configuration that securely fixes the sole to the foot and accommodates the wide range of forces developed during sports or other vigorous activities. In addition, a need exists for strapping that is capable of dynamically adjusting itself as required during such use.

SUMMARY OF THE INVENTION

The present invention comprises a unique strapping configuration for footwear that provides for dynamic fit adjustment while securely and comfortably affixing a sole to a wearer's foot. In accordance with one exemplary embodiment of the present invention, the strapping comprises one or more straps suitably configured to create an adjustable X configuration which crosses over the wearer's instep. The strapping configuration preferably passes through a transverse channel in the midsole of the footwear under the wearer's arch. The present invention further comprises closed footwear incorporating the unique strapping configuration that securely fastens the footwear to the user's foot, even during sports or other vigorous activities.

The adjustable X configuration instep strap generally has a first end secured to a first side of the heel portion of the footwear, crosses forwardly and transversely over the wearer's instep, passes through a channel in the sole of the footwear at the midfoot, the longitudinal center of the sole, extends rearwardly and transversely back across the wearer's instep (thereby forming an X over the instep), and is adjustably and releasably secured to the second side of the heel portion of the footwear. Preferably, the channel is angled downwardly from rear to front in the longitudinal direction, parallel to the downward slope of the wearer's instep, so that the strap will lie flat on the wearer's instep and thereby more evenly carry forces that develop between the foot and the sole during sports or other vigorous activities.

The X configuration instep strap acts to secure the entire circumference of a wearer's foot to the footwear sole. In the preferred embodiment, the strap passes under the wearer's arch through the midfoot channel, and thereby works to secure the entire transverse midfoot portion of the sole to the bottom of the wearer's foot. Further, as the strap passes through the channel it similarly operates to force the sole upward from near its center of gravity.

In an alternative embodiment of the present invention, multiple straps may be provided for creating the X configuration, rendering the midfoot channel optional. The straps are secured to the medial and lateral sides of the footwear, again crossing over the instep to provide the X configuration.

The present invention encompasses various footwear designs incorporating the aforesaid X-strap. For example, the footwear of the invention comprises open footwear such as a sandal. However, the present invention may also include closed footwear, such as hiking boots, skates, basketball shoes, and the like. In this regard, it is to be understood that as used herein the term "footwear" is intended to encompass closed footwear such as running and basketball shoes, hiking boots, in-line skates, ice skates, ski boots, snowboard boots, and the like.

BRIEF DESCRIPTION OF DRAWINGS

Additional aspects of the present invention will become evident upon reviewing the non-limiting embodiments described in the specification and the claims taken in conjunction with the accompanying figures, wherein like numerals designate like elements, and:

FIG. 5 is a detailed medial side view of the midfoot channel of the strapping system of the invention.

FIG. 6 is a bottom plan view of the midfoot channel of the strapping system of the invention.

DETAILED DESCRIPTION OF EXEMPLARY EMBODIMENTS

The following descriptions are only of exemplary embodiments of the invention only, and are not intended to limit the scope, applicability, or configuration of the invention in any way. Rather, the following description is intended to provide convenient illustrations for implementing different embodiments of the invention. As will become apparent, various changes may be made in the function and arrangement of the elements described in these embodiments without departing from the spirit and scope of the invention as set forth in the appended claims.

Further, as used herein, "footwear" means footwear of any type, including, but not limited to closed shoes such as shoes, boots, skates and the like. Generally, the footwear, as is conventional, includes a forefoot and heel portion, with a midfoot portion therebetween.

In general, in accordance with the present invention, footwear comprises a strapping configuration that provides for dynamic fit adjustment while securely and comfortably affixing a sole to a wearer's foot. Preferably, the strapping suitably includes an adjustable X configuration which crosses over the wearer's instep, and passes through a transverse channel in the midsole of the footwear under the wearer's arch. One skilled in the art will appreciate, however, that according to various alternative aspects of the present invention, single or multiple straps may be provided which are suitably attached to the footwear rather than passing through the midsole. Further, one skilled in the art will also appreciate that alternative strapping configurations, some of which are described below, which securely and comfortably affix a sole to a wearer's foot, also fall within the scope of the present invention.

Figure 1:
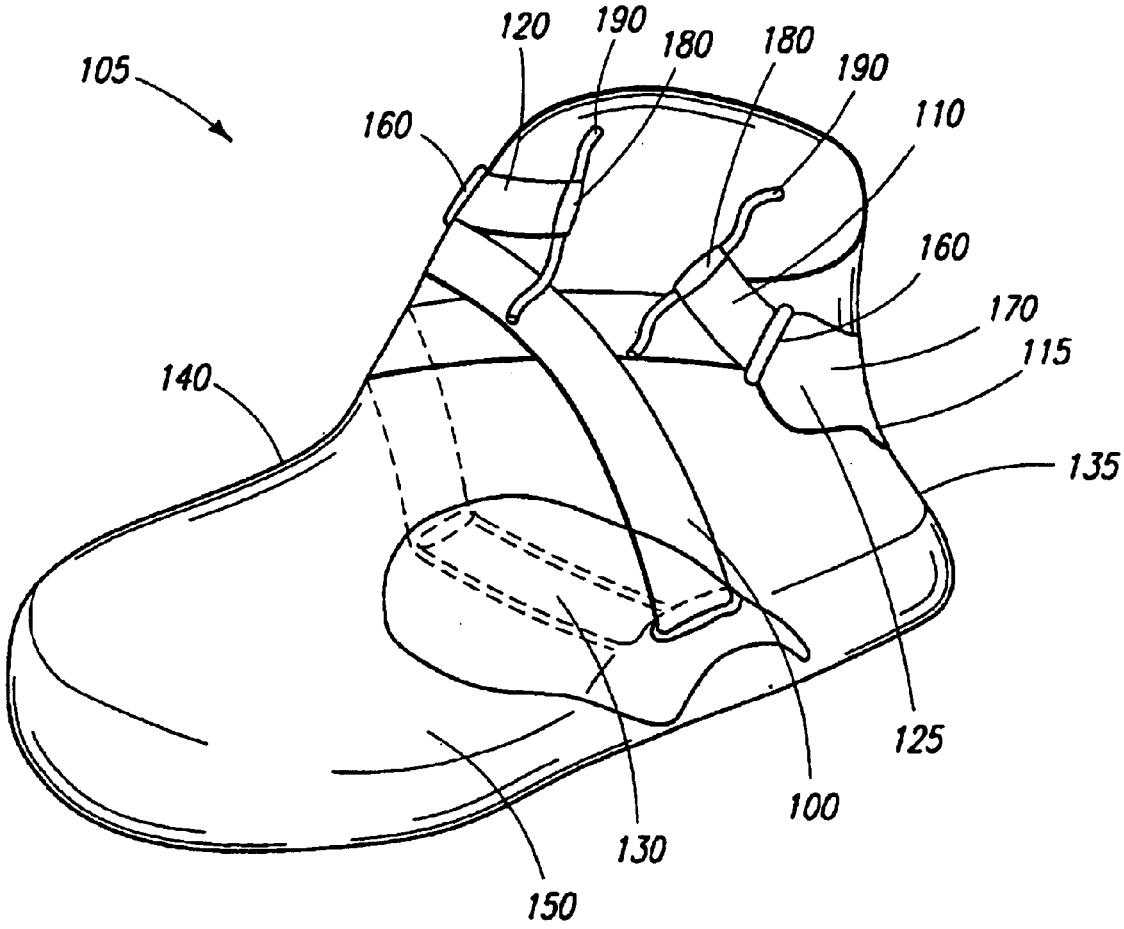
FIG. 1 is a perspective view of a preferred embodiment of the strapping system of the invention.

With reference to FIG. 1 in accordance with a preferred embodiment of the present invention, a strap 100 with a first end 120 and a second end 130 extending transversely across and forwardly across and over the instep of a wearer's foot. Strap 100 may be fabricated from any suitable flexible material having sufficient tensile strength, such as a woven fabric or leather. A preferred strap comprising woven nylon is well known in the art. Fabric weaves may also include reflective material, thereby providing 360° reflectivity for enhanced user safety.

Preferably, a channel 130 is provided through the midfoot portion of a sole of the footwear 105. underlying the user's arch and, as more fully explained below strap 100 passes through the midfoot channel 130, entering at the medial side 140 and emerging at the lateral side 150.

Figure 2:
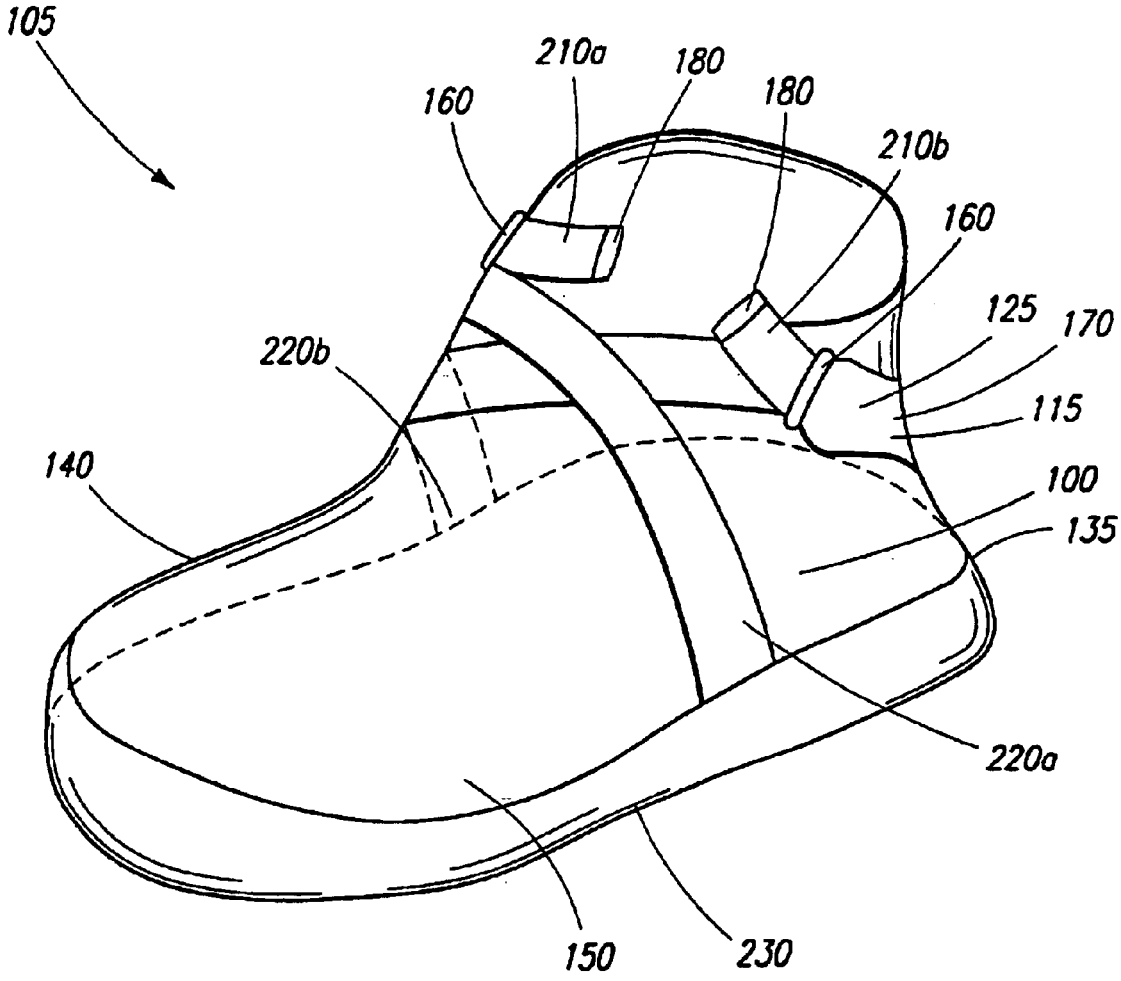
FIG. 2 is a perspective view of an alternative embodiment of the strapping system of the invention.

However, in accordance with an alternative aspect of the present embodiment, strap 100 may be comprised of multiple straps which can render channel 130 optional. For example, with reference to FIG. 2 strap 100 is comprised of a first strap 210*a* and a second strap 210*b*. First and second straps 210*a, b* have securing ends 220*a, b* which are attached to footwear 105 on the lateral 150 and medial sides 140 of the footwear 105 where the sole is connected to the upper. Preferably, securing ends 220*a, b* are attached by stitching them to the footwear 105, but any similar means such as adhesives, staples and the like may likewise be used. Of course, one skilled in the art can appreciate that securing ends 200*a, b* can also be attached elsewhere on the footwear 105 other than where the sole is connected to the upper, such as, for example, directly to the sole, upper itself or midsole.

Referring back to FIG. 1, after passing through channel 130, first and second ends 120, 130 of strap 100 then extend in a rearward, transverse direction back across the foot instep passing through pivot loops 160 attached to the footwear 105. Pivot loops 160 preferably comprise "loops" of the same material as upper. However, loops 160 may be comprised of any similar structure, for example rings, hooks and the like and similarly may be comprised of any suitable material such as plastic, metals, nylon and the like. First and second ends 120, 130 pass through loops 160 and change direction to cross over the instep of the wearer.

In accordance with the present embodiment, loops 160 are suitably connected to footwear 105 using loop connectors 170. Loop connectors 170 are preferably configured as strap-like members with a rear side 115 affixed proximate to a heel 135 of the footwear 105. Preferably rear sides 115 are sewn onto the upper of footwear 105, though rear sides may also be attached with adhesives, staples and the like. A front side 125 of connector 170 suitably retains loop 160 such that loop 160 is positioned so that strap 100 can pass through and cross over the instep of the wearer.

After passing through loops 160, first and second ends 120, 130 then travel transversely across the instep of a wearer's foot. Strap 100 may thereby be adjustably and removably attached to itself by pulling it through pivot loop 160 to a desired tightness and releasably fixing first and second ends 120, 130.

Figure 3:
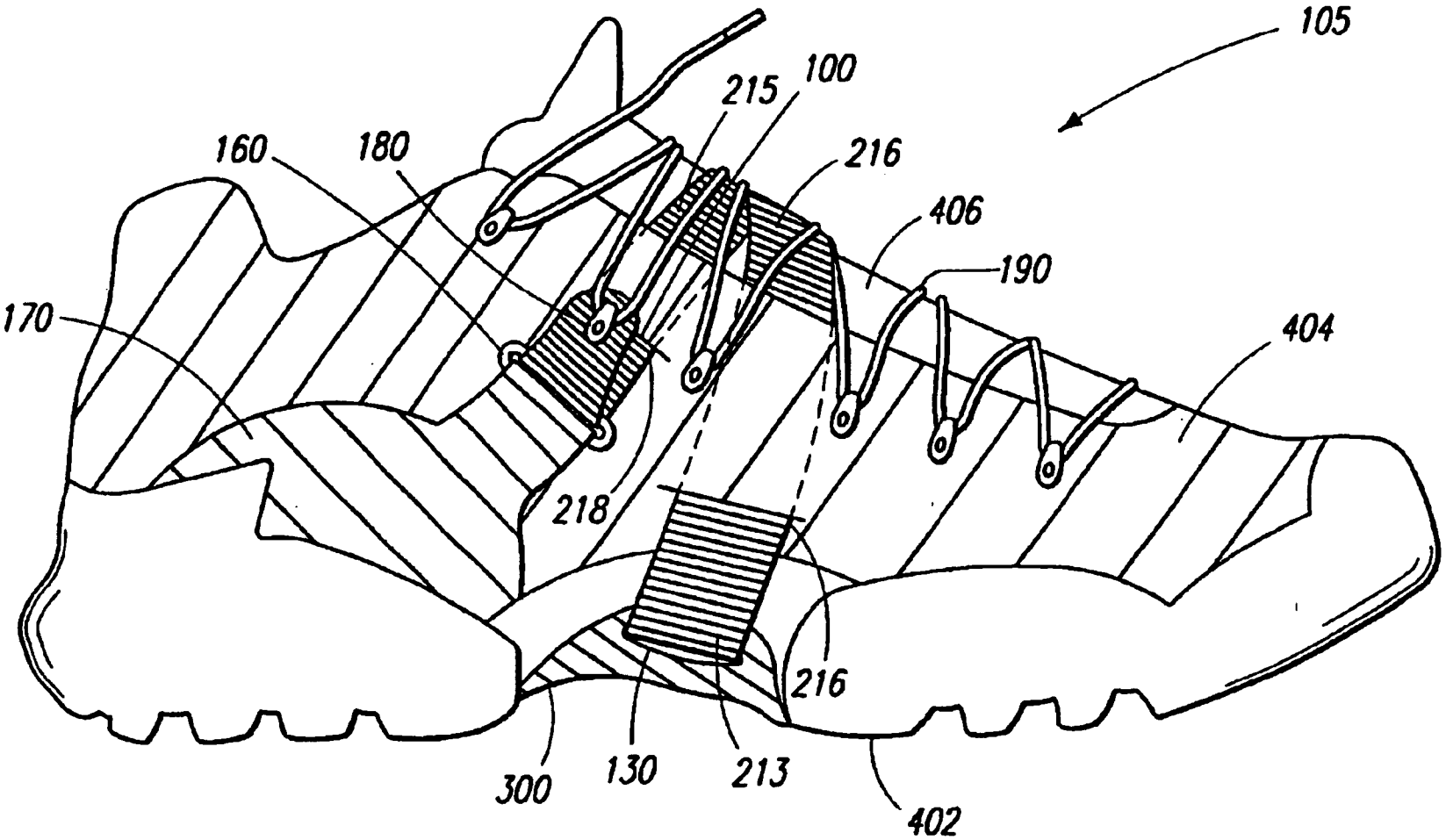
FIG. 3 is a side elevational view of a running shoe embodiment of the invention incorporating the X-strap of the invention.
Figure 4:
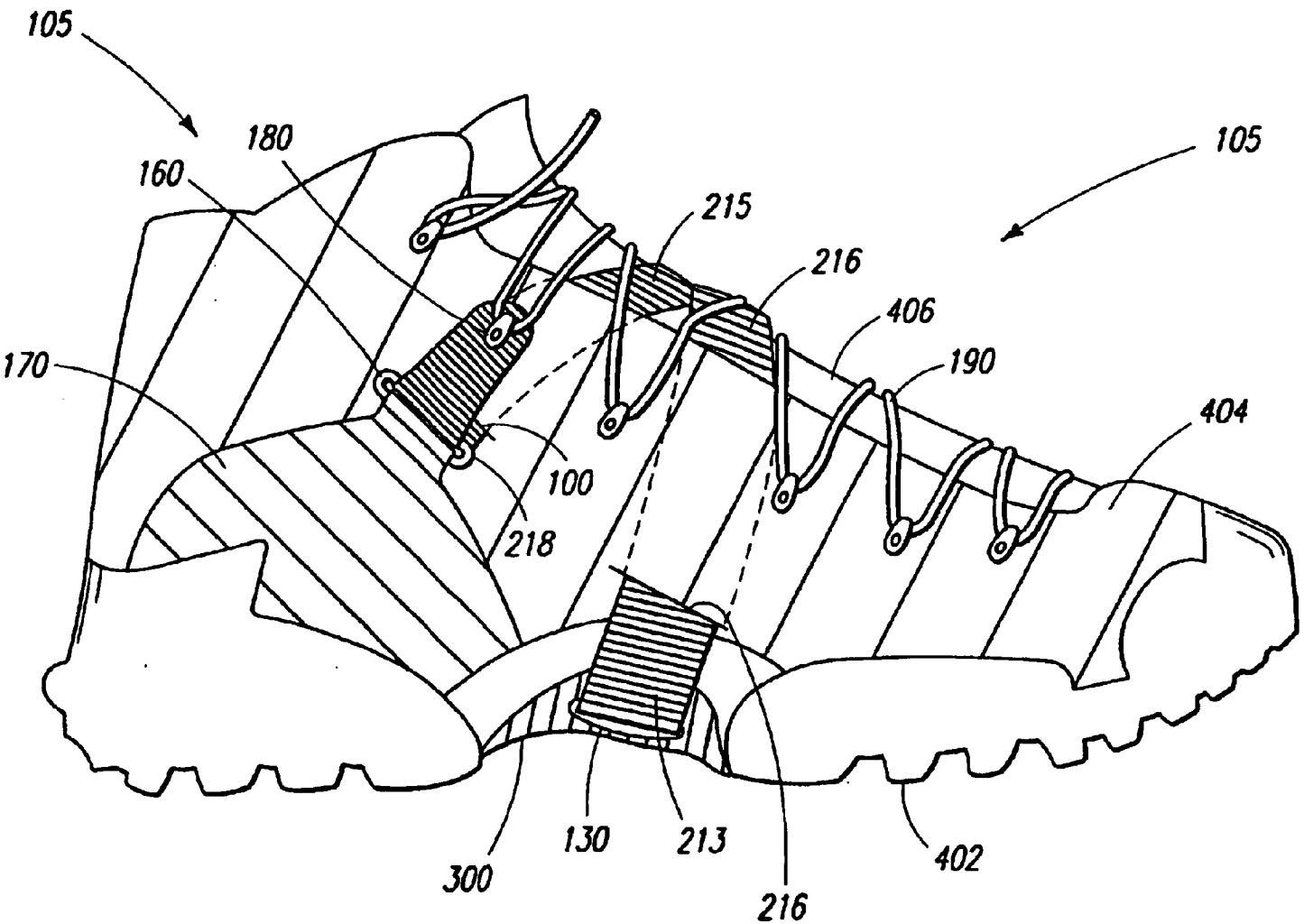
FIG. 4 is a side elevational view of a hiking boot embodiment of the invention incorporating the X-strap of the invention.

In the preferred embodiment, strap 100 is affixed to itself with lace loops 180 through which typical shoelaces 190 may pass. For example, FIG. 3 shows a running shoe and FIG. 4 shows a hiking boot using lace loops 180. When the laces 190 of the footwear 105 are tightened, strap 100 is likewise suitably tightened as well.

In accordance with alternative embodiments of the present invention, other means of attaching strap ends 120, 130 to tighten and secure strap 100 may also be used. For example, first and second ends 120, 130 may be attached directly to one another through mating female-male connectors, buckles, friction buckles, snaps, shoe laces, or other fasteners known in the art.

Figure 8:
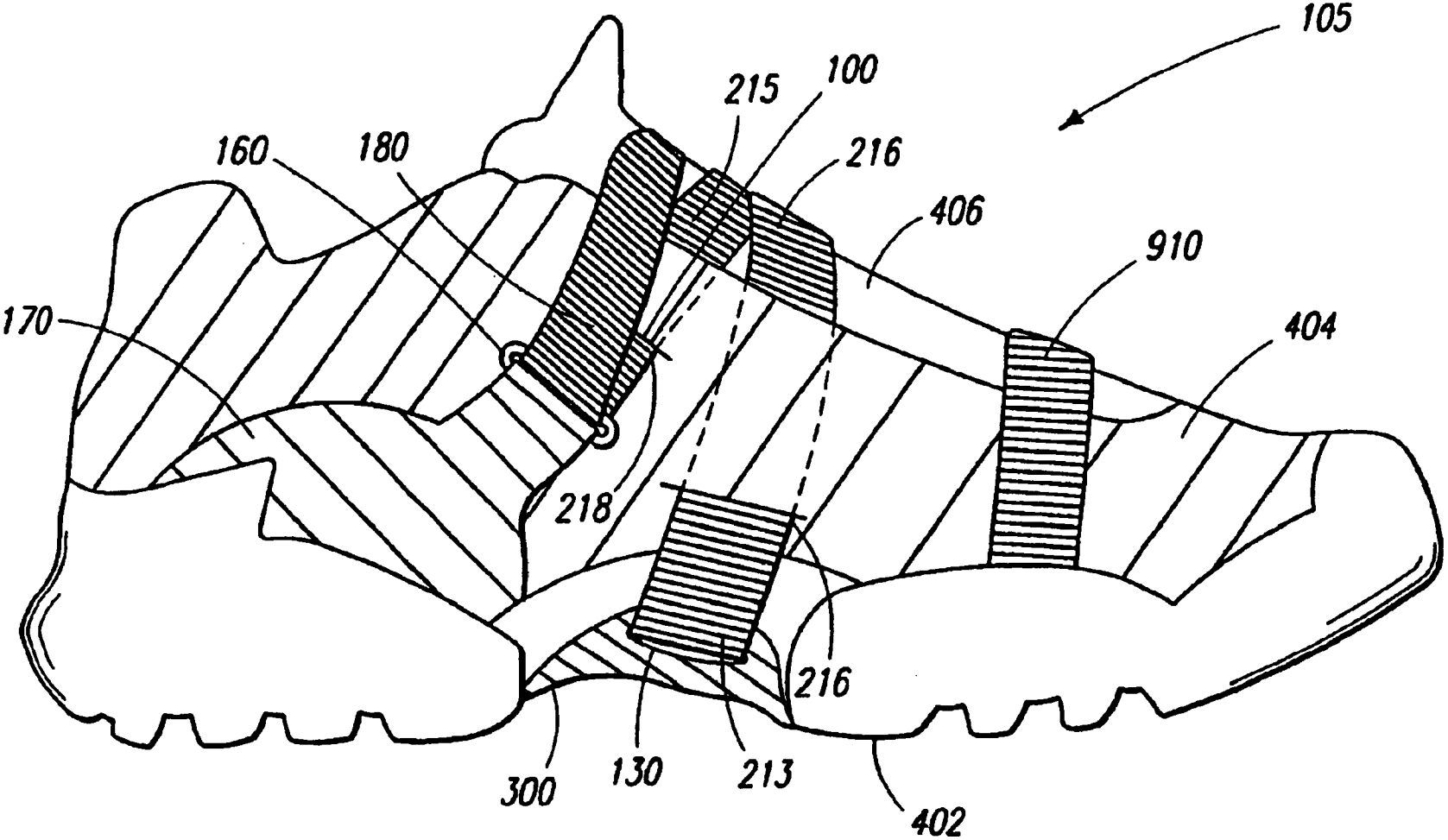
FIG. 8 is a side elevational view of another alternative embodiment of the footwear of the present invention.

According to still another aspect of the present invention and referring now to FIG. 8, shoe laces may be removed entirely. Rather, strap ends 120, 130 may be affixed to one another using any of the aforementioned means or otherwise, thereby allowing strap 100 to be the sole means for securing the footwear to the foot. Additionally, in accordance with various embodiments, one or more toe straps 910 may be suitably provided to provide additional support and/or securement to the forefoot.

Figure 7:
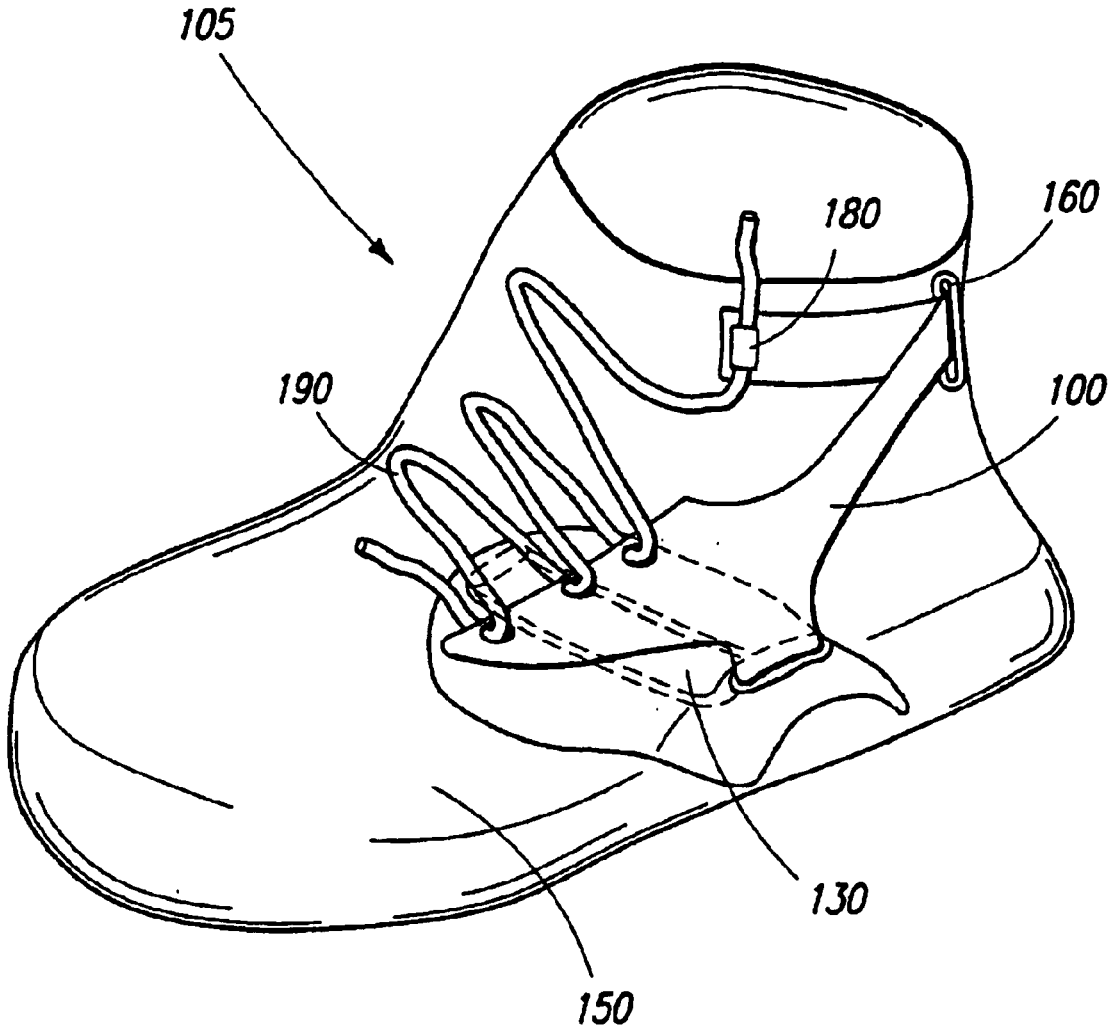
FIG. 7 is a perspective view of another alternative embodiment of the footwear of the present invention.

Of course in accordance with alternative embodiments of the present invention, the X configuration need not be formed by strap 100 itself. For example, FIG. 7 is a hiking boot 105 exemplary of using laces 190 to form the X configuration. As strap 100 exits channel 130, strap 100 suitably widens and accommodate lace loops 710 for laces 190. As is conventional in many footwear designs the lace cross the instep of the wearer, and completing the X configuration of strap 100.

Likewise, one skilled in the art should appreciate that loop rings 160 can be positioned at varying positions on the footwear 105 in accordance with strength, support and securement considerations. For example, with continued reference to the hiking boot 105 of FIG. 7, loops rings 160 are positioned farther back proximate to the heel of hiking boot 105. This positioning can contribute to additional heel support, ankle support and the like. Similarly, loop rings 160 can be positioned higher or lower on the footwear for analogous considerations.

FIG. 5 is an expanded medial side view of the midfoot channel 130 in the sole midfoot region 300 with strap 100 passing through. As shown in FIG. 6 midfoot channel 130 extends across the width of the midfoot region of the sole and is substantially perpendicular to a longitudinal axis of the sole. In accordance with one aspect of the present invention, the sole midfoot region 300 is comprised of a resilient, stiff material so that midfoot channel 130 will not collapse and thereby pinch strap 100 when force is applied downward on the sole midfoot region 300 during use. The stiffness and resiliency of sole midfoot region 300 also imparts advantageous strength and torsional rigidity to the sole. To facilitate convenient and efficient manufacture, sole midfoot region 300 is preferably manufactured separate from the softer and more pliable sole and attached thereto with an adhesive or the like. Alternative methods of manufacture may be used, such as molding the sole midfoot region 300 integrally with the other portions of the sole as will be described below.

Because strap 100 passes through arch channel 130, when it is urged upwards it will act upon the entire cross section of the sole. Thus when strap 100 is tightened to a desired fit it responds by forcing the entire cross section of the sole arch region upwards from near its center of gravity towards the foot while simultaneously forcing the top and sides of the foot instep downward towards the sole. This results in an advantageous snug fit between sole and foot throughout substantially the entire range of motion of the foot. This also provides improvement over prior art strapping systems that do not attach across the entire transverse section of the sole.

Further, as strap 100 is free to shift through midfoot channel 130, a dynamic, self-adjusting fit is achieved. As the foot may shift and move about during use, midfoot channel 130 allows strap 100 freedom to respond. This allows for strap 100 to maintain its fit across the foot instep and for maintenance of a correspondingly firm, responsive, and comfortable fit even during vigorous activity. 10130457 - SPEC Page 7 of 10 (May 16, 2002)

FIG. 5 shows the preferred forward angle of midfoot channel 130. Channel 130 is angled forward and downward at an angle of Ø, roughly parallel to a person's instep. As the respective ends of the X-strap 100 extend upward and over the wearer's instep, this angle will be maintained, causing the surface of strap 100 to lie approximately flat on the sloping instep of the wearer's foot. Angling the channel in a downward and forward longitudinal direction desirably directs the respective ends of strap 100 in a forward and upward direction closely matching a typical forward and upward direction that the sole is pulled by the foot during walking or running. In this manner the angling of channel 130 contributes to maximizing the ability of strap 100 to absorb forces developed during use, and provides for user comfort as strap 100 will tend to lie flat on a wearer's instep. Angle Ø is preferably between 2° and 15°, and most preferably between 3° and 6° measured from a horizontal plane as shown in FIG. 5.

The present invention encompasses footwear 105 having the aforesaid X-strap. Various features of the invention are equally applicable to open footwear such as sandal and closed footwear such as shoes, boots, skates, and the like, as will be illustrated hereinbelow.

Sole midfoot region 49 is preferably fabricated from a resilient and relatively stiff material to provide desirable torsional rigidity to the softer and more pliable sole 51. In addition, the stiff and relatively rigid construction of midfoot region, or shank 49, provides support to the arch region of a wearer's foot. Advantages related to torsional rigidity and arch region support will be discussed in greater detail below in association with additional embodiments of the invention.

Because preferred sole midfoot region 49 is comprised of a resilient plastic material while sole 51 is comprised of a softer, more pliable material, sole midfoot region 49 is preferably manufactured separate from sole 51 and then affixed thereto using adhesives or the like. Midfoot region 49 need not necessarily be prepared separately from sole 51 and attached thereto; it may also be integral with sole 51. Sole 51 is constructed as generally known in the art, and may, for example, be comprised of a relatively tough and wear resistant outsole, and a softer and more cushioned midsole. A soft insole or footbed for contact with the wearer's foot may be adhered to the upper surface of the sole. As used herein, the term "sole" refers to the structural sole of the footwear 105, and includes a unitary sole, an outsole and/or midsole, but does not encompass an insole. Sole 51 is preferably molded or ethylene vinyl acetate.

As the midfoot portion or shank 49 of the sole is preferably formed of stiff material, channel 47 will not collapse and pinch strap 41 while the footwear 105 is in use. Strap 41 will thereby move freely through channel 47. As discussed previously, movement of strap 41 during use is most desirable to provide for a secure, dynamic, and self-adjusting fit. In addition, channel 47 is also angled forward and downward from the horizontal to provide the advantages discussed earlier, including maximizing user comfort and absorbing forces developed during walking and running.

Although various of the embodiments of the X-strap of the invention have been illustrated and described herein as generally in use with sandals, it will be understood by those knowledgeable in the art that the X-strap of the invention may likewise prove advantageous for use with other types of footwear 105. In particular, the X-strap of the invention will be useful in any application where a snug, responsive, and dynamic fit between foot and footwear 105 is desired. As examples, the X-strap may be incorporated in athletic footwear 105, hiking footwear 105, ski boots, snowboard boots, ice skates, and in-line roller skates.

Thus, referring back to FIGS. 3 and 4, FIG. 3 illustrates a side elevational view of a running shoe and FIG. 4 illustrates a hiking boot incorporating the X-strap of the invention. The X-strap of the invention is configured consistently on both the running shoe of FIG. 3 and the hiking boot of FIG. 4, description of the two footwear 105 embodiments can be made using common element references. Running shoe and hiking boot 105 generally comprise sole 402, upper 404, tongue 406, and lacing 190. Substantially rigid shank 300 has channel 130- extending transversely therethrough, as generally described above.

A first portion 213 of an instep strap passes through channel 130, and emerges on a first side of the footwear 105. A second portion 214 of the instep strap passes into upper 404 through a passage 216 therein, extends within upper 404, and exits upper 404 to pass over tongue 406. The second strap portion 214 is then adjustably connected to a second side of the heel portion of the footwear 105.

In like manner, a third portion 215 of the instep strap extends out of the second side of channel 130 (not illustrated), passes over tongue 406, and is adjustably connected to the first side of the heel portion of the footwear 105 by connector 170. Strap second portion 214 and third portion 215 thereby form an X configuration over tongue 406. As illustrated in FIGS. 3 and 4, strap third portion 215 passes under upper 404 and exits therefrom at passage 218. Strap third portion 215 is connected to the sole heel portion by loop connector 120, which is in turn connected to the heel portion of sole 202 by fabric piece 224. Strap third portion 215 is adjustably fastened by shoe lace 208 passing through lace eyelet 180.

It is also noted that the instep strap need not pass over tongue 206, but may also pass beneath it or within a passage provided therein. In addition, the instep strap need not pass into upper 404 at passages 216 and 218, but may lie over or under upper 404. Should the instep strap pass into upper 404 as illustrated, fabric or plastic passages may be provided within upper 404 generally along the dashed paths of FIGS. 3 and 4. Further, footwear 105 embodiments of the invention are possible that will incorporate the instep strap residing completely within a footwear 105 upper.

Lastly, while the principles of the invention have been described in illustrative embodiments, it should be apparent that many modifications of structure, arrangement, proportions, the elements, materials and components of the footwear, used in the practice of the invention and not specifically described, may be varied and particularly adapted for specific applications and operating requirements without departing from those principles.

What is claimed is:

1. A footwear securement system comprising:

a closed footwear item, said closed footwear having an upper and a sole portion and lateral and medial sides;

a first strap having an X-configuration located at the instep portion of said upper;

a channel disposed within said sole, said channel permitting said first strap to pass therethrough; and said first strap connected to the lateral side of said upper, crossing said instep portion of said upper and entering said channel on said medial side of said closed footwear, exiting said channel on said lateral side of said closed footwear, crossing the instep and connected to the medial side of said upper.

2. A footwear securement system according to claim 1 further comprising a second strap to engage said first strap.

3. A footwear securement system according to claim 2 wherein said second strap is a shoelace.

4. A footwear securement system according to claim 2 further comprising pivot loops configured in said upper for engaging said first strap.

5. A footwear securement system according to claim 2 further comprising a fastener attached to said first strap, wherein said fastener is adjustable for adjusting the length of said first strap.

6. A footwear securement system according to claim 2 wherein said X-configuration is located on interior side of said upper.

7. A footwear securement system according to claim 2 wherein said X-configuration is located on the exterior side of said upper.

8. A footwear securement system according to claim 1 wherein said strap is free to shift through said channel.

9. A footwear securement system comprising:

a closed footwear item, said closed footwear item having an upper and a sole portion and first and second sides;

a first strap originating from said first side of said sole, crossing the instep portion of said upper and terminating on said second side of said upper;

a second strap originating from said second side of said sole, crossing said instep portion of said upper and terminating on said first side of said upper; and a third strap, wherein the terminating ends of said first and said second straps are engaged by said third strap.

10. A footwear securement system according to claim 9, wherein said third strap is a shoelace.

11. A footwear securement system according to claim 10 further comprising pivot loops configured in said upper for engaging said third strap.

* * * * *